US009142884B2

(12) United States Patent
Yukimoto et al.

(10) Patent No.: US 9,142,884 B2
(45) Date of Patent: Sep. 22, 2015

(54) ANTENNA DEVICE

(75) Inventors: Shinsuke Yukimoto, Saitama (JP); Ryo Saito, Saitama (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 183 days.

(21) Appl. No.: 13/989,734

(22) PCT Filed: Nov. 21, 2011

(86) PCT No.: PCT/JP2011/006467

§ 371 (c)(1),
(2), (4) Date: May 24, 2013

(87) PCT Pub. No.: WO2012/073450

PCT Pub. Date: Jun. 7, 2012

(65) Prior Publication Data

US 2013/0249742 A1 Sep. 26, 2013

(30) Foreign Application Priority Data

Nov. 30, 2010 (JP) ..... 2010-267804

(51) Int. Cl.
*H01Q 9/04* (2006.01)
*H01Q 1/38* (2006.01)
(Continued)

(52) U.S. Cl.
CPC ..... *H01Q 1/38* (2013.01); *H01Q 1/2283* (2013.01); *H01Q 9/36* (2013.01); *H01Q 9/42* (2013.01)

(58) Field of Classification Search
CPC ..... H01Q 9/04; H01Q 21/30; H01Q 1/38; H01Q 1/24
USPC ..... 343/749, 702, 700 MS, 767
See application file for complete search history.

(56) References Cited

U.S. PATENT DOCUMENTS 4,924,237 A * 5/1990 Honda et al. ..... 343/702
5,936,583 A * 8/1999 Sekine et al. ..... 343/702
(Continued)

FOREIGN PATENT DOCUMENTS

CN 1926720 A 3/2007
CN 1972008 A 5/2007
(Continued)

OTHER PUBLICATIONS

International Search Report of PCT/JP2011/006467.
(Continued)

*Primary Examiner* — Huedung Mancuso
(74) *Attorney, Agent, or Firm* — Locke Lord LLP; Jeffrey D. Hsi

(57) ABSTRACT

Provided is an antenna device that is capable of ensuring sufficient antenna performance by maximally utilizing a limited antenna occupied area. The antenna device is provided with a substrate main body (2); a ground plane (GND) that is formed on the substrate main body; an antenna-occupied area (AOA) that is provided in contact with one side (2*a*) of the substrate main body; a slit section (S) that is bored in the ground plane so as to extend from this area in the direction opposite to the one side (2*a*) of the substrate main body; a power feeding pattern (3) that is formed so as to extend into the slit section, provided with a power feeding point at the base end side, and connected with a first passive element (P1) halfway while the tip end side extends into the antenna-occupied area toward the one side of the substrate main body; an antenna element (AT) of a dielectric antenna that is connected to the tip end of the power feeding pattern and positioned along the one side of the substrate main body; a second passive element (P2) that is connected between the antenna element (AT) and the adjoining ground plane; and a ground connection pattern (5) for connecting the tip end of the power feeding pattern with the ground plane.

2 Claims, 11 Drawing Sheets

(51) Int. Cl.

| | |
|---|---|
| ***H01Q 9/36*** | (2006.01) |
| ***H01Q 1/22*** | (2006.01) |
| ***H01Q 9/42*** | (2006.01) |

(56) References Cited

U.S. PATENT DOCUMENTS

| | | | | |
|---|---|---|---|---|
| 7,109,928 | B1 * | 9/2006 | Thiele et al. | 343/700 MS |
| 2002/0033773 | A1 * | 3/2002 | Hirabayashi | 343/702 |
| 2004/0145525 | A1 * | 7/2004 | Annabi et al. | 343/700 MS |
| 2005/0099347 | A1 | 5/2005 | Yamaki | |
| 2006/0170597 | A1 * | 8/2006 | Kurashima et al. | 343/700 MS |
| 2006/0176221 | A1 * | 8/2006 | Chen et al. | 343/702 |
| 2012/0274536 | A1 * | 11/2012 | Pan | 343/853 |

FOREIGN PATENT DOCUMENTS

| | | | |
|---|---|---|---|
| EP | 2192653 | A2 | 6/2010 |
| JP | 2002271123 | A | 9/2002 |
| JP | 2005020266 | A | 1/2005 |
| JP | 2005236534 | A | 9/2005 |
| JP | 2005252366 | A | 9/2005 |
| JP | 2006101486 | A | 4/2006 |
| JP | 2007096363 | A | 4/2007 |
| JP | 2008252517 | A | 10/2008 |

OTHER PUBLICATIONS

Search Report for European Patent Application No. 11844721 dated Jun. 25, 2014.

Chinese Office Action dated Jun. 4, 2014 issued for corresponding Chinese Patent Application No. 201180056958.7.

* cited by examiner

ANTENNA DEVICE

CROSS-REFERENCE TO RELATED APPLICATIONS

This application claims priority to PCT International Application No. PCT/JP2011/006467 filed Nov. 21, 2011, which claims the benefit of Japanese Patent Application No. 2010-267804 filed Nov. 30, 2010, the entire contents of the aforementioned applications are hereby incorporated herein by reference.

BACKGROUND OF THE INVENTION

1. Field of the Invention

The present invention relates to an antenna device using a dielectric antenna.

2. Description of the Related Art

Conventionally, in communication equipment, a surface mounting antenna using a dielectric, i.e., a dielectric antenna has been used as one of antenna elements mounted onto a wireless circuit substrate. In the dielectric antenna, a radiation electrode for antenna operation is provided on a dielectric substrate. Conventionally, an open-end type antenna such as a monopole antenna or an inverse F-type antenna using this dielectric antenna has been a mainstream.

In general, in the case of an open-end type antenna such as a monopole antenna or an inverse F-type antenna, impedance of the open end is high, and thus, the distance between a mounted antenna element and a ground needs to be ensured as long as possible. For this purpose, in order to sufficiently ensure antenna performance, the antenna element needs to be far away from a ground plane by removing the ground around the periphery of the mounted antenna element in a substrate on which a ground plane is formed. However, when a dielectric antenna is actually mounted as an antenna element onto a substrate, a space (antenna-occupied area) which can be used as an antenna is often limited by taking into consideration size reduction of equipment. Consequently, sufficient antenna performance cannot be exhibited by the influence of the ground around the periphery of the antenna element. Hence, the position where an antenna element is mounted is often set at the end of a substrate in order to minimize the influence of the ground.

In the conventional technique, for example, Patent Document 1 discloses an antenna structure in which a capacitance power supply radiation electrode for antenna operation is provided on a base member, the base member is mounted on a non-ground area of a circuit substrate, and a grounding line for electrically connecting an earth electrode on the circuit substrate and the radiation electrode on the base member is provided. In the antenna structure, the grounding line has a shape having a folded back portion. In addition, Patent Document 2 discloses an antenna structure that comprises a surface mounting antenna in which a radiation electrode for antenna operation is formed on a base member and a substrate having a ground area where a ground electrode is formed and a non-ground area where no ground electrode is formed, wherein the one end side of the radiation electrode is a ground connection portion which is grounded to the ground electrode.

PRIOR ART DOCUMENTS

Patent Documents

Patent Document 1: WO 2006/120762
Patent Document 2: WO 2008/035526

SUMMARY OF THE INVENTION

Problems to be Solved by the Invention

However, the following problems still remain in the conventional techniques described above.

In the technique disclosed in Patent Document 1, antenna performance largely depends on the folded back portion of a grounding line. Consequently, deterioration of antenna performance and an increase in unstable factors may occur depending on the state of the folded back portion. Specifically, an antenna-occupied area needs to be enlarged by ensuring the length of the folded back portion. Thus, sufficient antenna performance may not be obtained when the antenna-occupied area is limited.

In the technique disclosed in Patent Document 2, there is no power feeding point on the antenna element itself which is capacitively-coupled to the power supply electrode on the substrate and the radiation electrode is directly connected to the ground. Consequently, antenna performance depends on the state of the ground plane, and thus, it is difficult to improve antenna performance. Although Patent Document 2 also describes the form where the antenna element is connected to the ground via an inductor or a capacitor in order to adjust the resonance frequency, it is still difficult to suppress the flow of high-frequency current to be diffused throughout the ground, and thus, an antenna-occupied area needs to be enlarged. Since a stray capacitance between the antenna element and the ground is suppressed, antenna performance depends on the radiation portion of the antenna element. Consequently, antenna performance is affected by the state of the periphery of the antenna element and thus is difficult to be improved.

As described above, conventionally, an antenna-occupied area including an antenna element and its peripheral elements needs to be enlarged in order to improve antenna performance. Consequently, the degree of freedom in design is small, resulting in a difficulty in improvement in antenna performance.

The present invention has been made in view of the aforementioned circumstances, and an object of the present invention is to provide an antenna device that can ensure sufficient antenna performance by maximally utilizing a limited antenna occupied area.

Means for Solving the Problems

The present invention adopts the following structure in order to solve the aforementioned problems. Specifically, the antenna device of the present invention is characterized in that the antenna device includes an insulating substrate main body; a ground plane which is patterned with metal foil on the substrate main body; an antenna-occupied area that is provided in contact with one side of the substrate main body on the substrate main body as an area in which the ground plane is not formed; a slit section that is bored in the ground plane so as to extend from the antenna-occupied area in the direction opposite to the one side of the substrate main body; a power feeding pattern that is patterned with metal foil so as to extend into the slit section, provided with a power feeding point at the base end side, and connected with a first passive element halfway while the tip end side extends into the antenna-occupied area toward the one side of the substrate main body; an antenna element of a dielectric antenna that is constituted by a dielectric base body, a conductor pattern formed on the surface of the dielectric base body, and a pair of electrodes which are connected to each other by the conductor pattern and are formed at both ends of the dielectric base body and is placed along the one side of the substrate main body while one end of the electrodes is connected to the tip end of the power feeding pattern and; a second passive element that is connected between the other end of the electrodes of the antenna element and the ground plane adjoining thereto; and a ground connection pattern having an inductance that is patterned with metal foil, connects the tip end of the power feeding pattern with the ground plane opposite to the antenna element.

Since the antenna device includes an antenna element of a dielectric antenna that is placed along the one side of the substrate main body while one end of the electrodes is connected to the tip end of the power feeding pattern extending within an antenna-occupied area, and a second passive element that is connected between the other end of the electrodes of the antenna element and the ground plane adjoining thereto, and a ground connection pattern having an inductance that connects the tip end of the power feeding pattern with the ground plane opposite to the antenna element, current distribution is concentrated within the antenna-occupied area so that the flow of high-frequency current diffused to the ground plane can be suppressed. In other words, the influence of peripheral components or the like upon installation on antenna performance can also be reduced.

Specifically, in the antenna device, a parallel resonance obtained by an inductance of the ground connection pattern, a stray capacitance due to a gap between one end (power feeding terminal) of the electrodes of the antenna element and the ground plane, and a stray capacitance between the antenna element and the ground plane, a series resonance obtained by the antenna element and the first passive element, and a resonance obtained by the loop shape from the first passive element via the power feeding pattern, the antenna element, the second passive element, and the inside edge of the ground plane to the first passive element occur. Thus, the flow of high-frequency current to be diffused throughout the ground plane is suppressed by two types of parallel resonances obtained respectively from the left and right sides of the power feeding pattern so that high antenna performance can be obtained by maximally utilizing a limited antenna occupied area.

Also, the antenna device of the present invention is characterized in that the power feeding pattern extends to one side of the substrate main body and the ground connection pattern is formed in contact with one side of the substrate main body.

Specifically, in the antenna device, since the power feeding pattern extends to one side of the substrate main body and the ground connection pattern is formed in contact with one side of the substrate main body, the antenna element and the ground connection pattern are arranged at the edge of the substrate so that the antenna device can be utilized by deriving maximum performance from the antenna element.

Effects of the Invention

According to the present invention, the following effects may be provided.

Specifically, since the antenna device of the present invention includes an antenna element of a dielectric antenna that is connected to the tip end of the power feeding pattern extending within an antenna-occupied area and positioned along the one side of the substrate main body, a second passive element that is connected between the other end of the electrodes of the antenna element and the ground plane adjoining thereto, and a ground connection pattern having an inductance that connects the tip end of the power feeding pattern with the ground plane opposite to the antenna element, the flow of high-frequency current diffused to the ground plane can be suppressed and high antenna performance can be obtained even when an antenna-occupied area is small.

Thus, the antenna device of the present invention not only realizes maximum antenna performance even in a space-saving arrangement but also can obtain high degree of freedom for installation.

BEST MODES FOR CARRYING OUT THE INVENTION

Hereinafter, a description will be given of an antenna device according to one embodiment of the present invention with reference to FIGS. 1 to 6.

Figure 1:
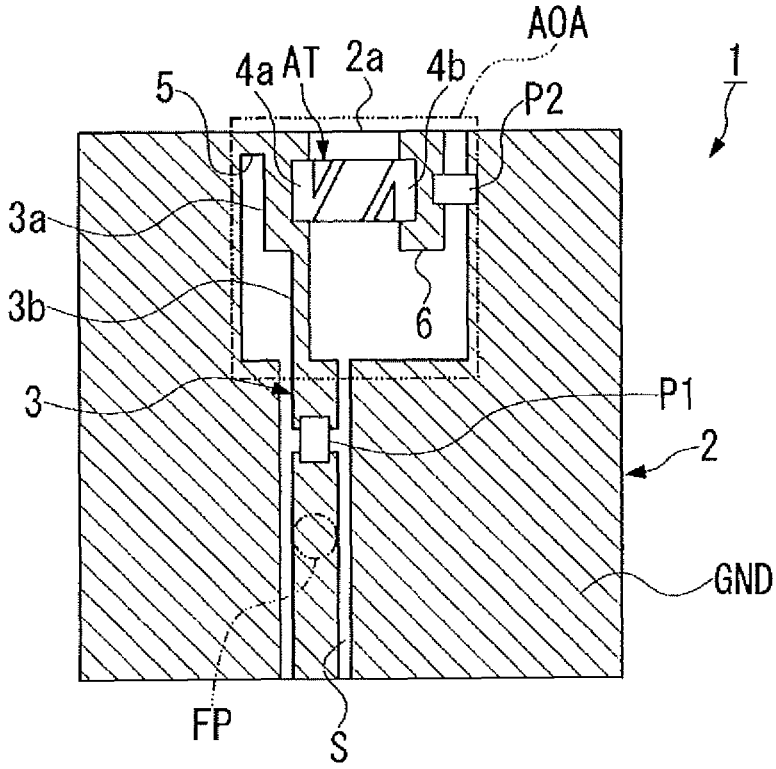
FIG. 1 is a plan view illustrating an antenna device according to one embodiment of the present invention.

As shown in FIG. 1, an antenna device (1) of the present embodiment includes an insulating substrate main body (2); a ground plane (GND) which is patterned with metal foil on the substrate main body (2); an antenna-occupied area (AOA) that is provided in contact with one side (2*a*) of the substrate main body (2) on the substrate main body (2) as an area in which the ground plane (GND) is not formed; a slit section (S) that is bored in the ground plane (GND) so as to extend from the antenna-occupied area (AOA) in the direction opposite to the one side (2*a*) of the substrate main body (2); a power feeding pattern (3) that is patterned with metal foil so as to extend into the slit section (S), provided with a power feeding point (FP) at the base end side, and connected with a first passive element (P1) halfway while the tip end side extends into the antenna-occupied area (AOA) toward the one side (2*a*) of the substrate main body (2); an antenna element (AT) of a dielectric antenna that is constituted by a dielectric base body (7), a conductor pattern (4) formed on the surface of the dielectric base body (7), and a pair of electrodes (4*a*) and (4*b*) which are connected to each other by the conductor pattern (4) and are formed at both ends of the dielectric base body (7) and is placed along the one side (2*a*) of the substrate main body (2) while one end (4*a*) (power feeding terminal) of the electrodes is connected to the tip end of the power feeding pattern (3); a second passive element (P2) that is connected between the other end (4*b*) (ending terminal) of the electrodes of the antenna element (AT) and the ground plane (GND) adjoining thereto; a ground connection pattern (5) having an inductance that is patterned with metal foil, connects the tip end of the power feeding pattern (3) with the ground plane (GND) opposite to the antenna element (AT); and an end side land portion (6) that is connected with the other end (4*b*) of the electrodes of the antenna element (AT) and one end of the second passive element (P2).

The power feeding pattern (3) extends to one side (2*a*) of the substrate main body (2), and the ground connection pattern (5) is formed in contact with one side (2*a*) of the substrate main body (2). The end side land portion (6) is also arranged at one side (2*a*) of the substrate main body (2).

The power feeding pattern (3) includes a power feeding-side land portion (3*a*) at the tip end to which one end (4*a*) of the electrodes of the antenna element (AT) is connected, and a fine line portion (3*b*) provided between the power feeding-side land portion (3*a*) and a portion at which the first passive element (P1) is connected. Also, the width of the power feeding-side land portion (3*a*) is formed wider than that of the fine line portion (3*b*) and the distance between the power feeding-side land portion (3*a*) and the ground plane (GND) adjoining thereto is set narrower than that between the fine line portion (3*b*) and the ground plane (GND).

Note that the power feeding point (FP) is connected to the power feeding point of a high-frequency circuit (not shown). The high-frequency circuit is mounted on the ground plane (GND).

As the first passive element (P1) and the second passive element (P2), an inductor, a capacitor, or a resistor may be employed. Frequency and impedance adjustment is made by the first passive element (P1) and the second passive element (P2) to a desired level. For example, in the present embodiment, an inductor is employed as the first passive element (P1) and a capacitor is employed as the second passive element (P2).

When a capacitor is employed as the second passive element (P2), series resonance (a part denoted by reference numeral R2 in FIG. 3) is obtained by the parallel stray capacitance of the stray capacitance (C4) and the capacitance of the second passive element (P2) and the inductance of the antenna element (AT).

Also, each pattern, the land portion, and the ground plane (GND) are patterned with metal foil such as copper foil.

Figure 2:
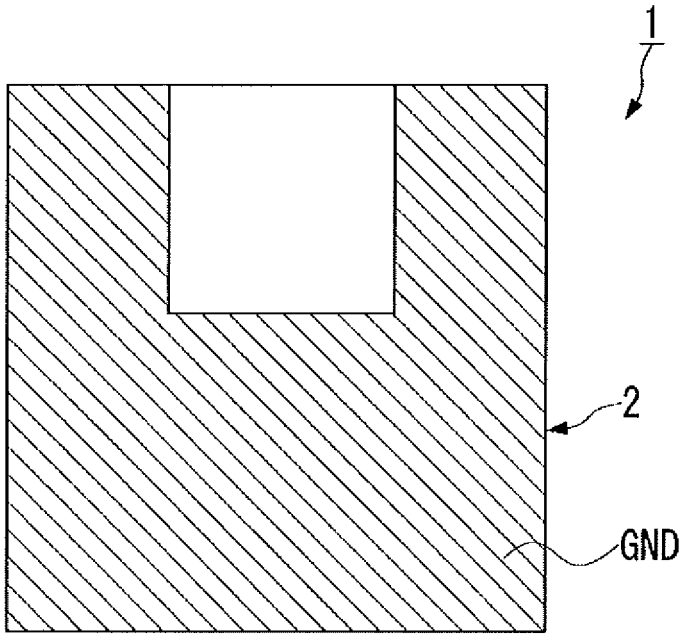
FIG. 2 is a bottom view illustrating an antenna device according to the present embodiment.

The substrate main body (2) is a typical printed circuit board. In the present embodiment, the main body of a printed circuit board made of a rectangular glass epoxy resin or the like is employed as the substrate main body 2. The antenna-occupied area (AOA) is provided on the surface of the substrate main body (2) by removing the ground plane (GND) in a substantially rectangular shape. As shown in FIG. 2, the ground plane (GND) is patterned on the rear surface of the substrate main body (2) and the ground plane (GND) corresponding to a portion directly below the antenna-occupied area (AOA) is removed therefrom.

Figure 4:
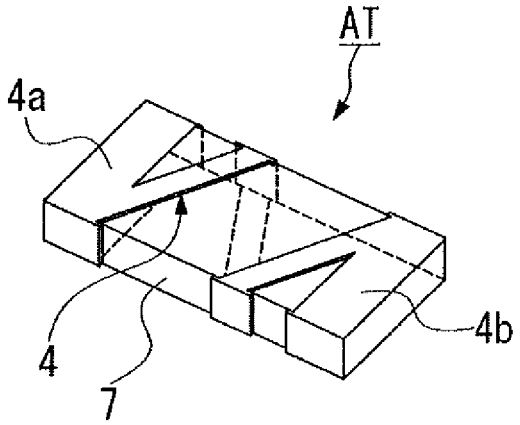
FIG. 4 is a perspective view illustrating an antenna element according to the present embodiment.
Figure 5:
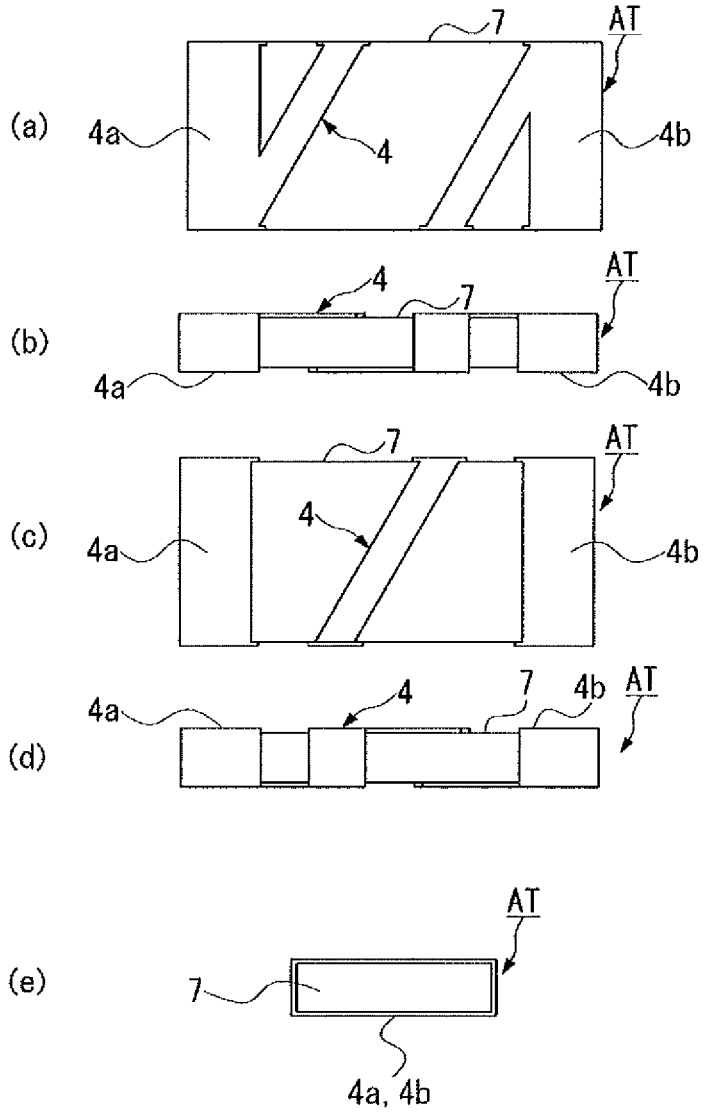
FIG. 5*a* is a plan view illustrating an antenna element according to the present embodiment.
FIG. 5*b* is a front view illustrating an antenna element according to the present embodiment.
FIG. 5*c* is a bottom view illustrating an antenna element according to the present embodiment.
FIG. 5*d* is a rear view illustrating an antenna element according to the present embodiment.
FIG. 5*e* is a side view illustrating an antenna element according to the present embodiment.

The antenna element (AT) is a loading element which is not self-resonant to a desired resonance frequency for antenna operation and is, for example as shown in FIG. 4 and FIG. 5, a chip antenna in which the conductor pattern (4) such as Ag or the like is formed on the surface of the dielectric base body (7) such as ceramics or the like. The dielectric material of the antenna element (AT), the size such as length or width thereof, and the winding number or the width of the conductor pattern (4) thereof are set depending on the resonance frequency setting or the like.

The impedance of the antenna element (AT) is determined by not only the inductance but also the capacitance that are inherent therein. It is preferable that the impedance of the antenna element (AT) be set to high in regard to a frequency used.

Specifically, the size of an antenna element is determined by a frequency used and a dielectric material used. The winding number of the conductor pattern (4), the pattern width, or the like is optimized by antenna required performance (the gain of the antenna, bandwidth, or the like). For example, in the antenna element (AT) shown in FIG. 4 and FIG. 5, the impedance of the antenna element (AT) in regard to a frequency used is optimized by setting the impedance value obtained by the winding number of the conductor pattern (4), the capacitance value obtained by the space width between lines of the conductor pattern (4), or the like.

As described above, in the antenna element (AT), one end (4*a*) of the electrodes, which serves as the power feeding terminal, is connected to the power feeding pattern (3) and the ground plane (GND) and the other end (4*b*) of the electrodes, which serves as the ending terminal, is connected to the ground plane (GND) via the second passive element (P2). Also, the antenna-occupied area (AOA) is divided into two areas of the power feeding terminal (the electrode (4*a*)) side and the ending terminal (the electrode (4*b*)) side by the power feeding pattern (3).

Figure 3:
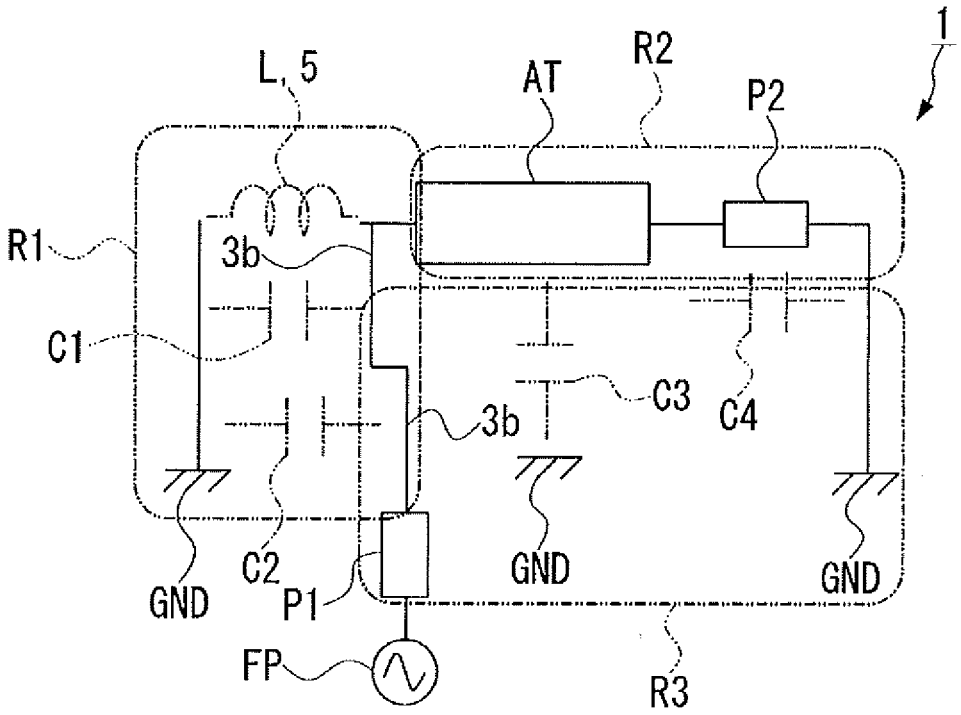
FIG. 3 is a schematic equivalent circuit view illustrating an antenna device according to the present embodiment.

As shown in FIG. 3, in the antenna device (1) of the present embodiment, the inductance (L) obtained by the ground connection pattern (5), the stray capacitance (C1) between the power feeding-side land portion (3*a*) of the power feeding pattern (3) and the ground plane (GND), the stray capacitance (C2) between the fine line portion (3*b*) of the power feeding pattern (3) and the ground plane (GND), the stray capacitance (C3) between the antenna element (AT) and the ground plane (GND) of the first passive element (P1) side, and the stray capacitance (C4) between the antenna element (AT) and the ground plane (GND) of the second passive element (P2) side are generated.

Specifically, a parallel resonance (a part denoted by reference numeral R1 in FIG. 3) obtained by the inductance (L) due to the ground connection pattern (5), the stray capacitance (C1) due to a gap between one end (power feeding terminal) (4*a*) of the electrodes of the antenna element (AT) and the ground plane (GND), and the stray capacitance (C2) between the antenna element (AT) and the ground plane (GND), a series resonance (a part denoted by reference numeral R2 in FIG. 3) obtained by the stray capacitance (C4) between the antenna element (AT) and the second passive element (P2), and a resonance (a part denoted by reference numeral R3 in FIG. 3) obtained by the loop shape from the first passive element (P1) via the power feeding pattern (3), the antenna element (AT), the second passive element (P2), and the inside edge of the ground plane (GND) to the first passive element (P1) occur. Thus, the flow of high-frequency current to be diffused throughout the ground plane (GND) is suppressed by two types of parallel resonances obtained respectively from the left and right sides of the power feeding pattern (3) so that high antenna performance can be obtained by maximally utilizing a limited antenna occupied area (AOA).

Figure 6:
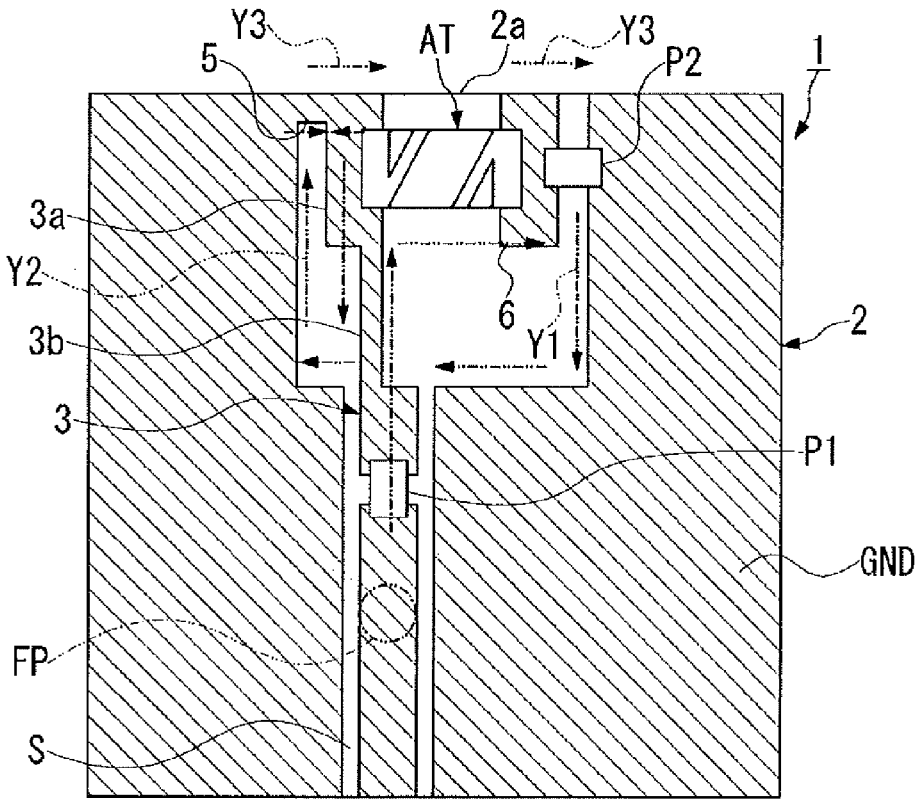
FIG. 6 is an explanatory view illustrating the flow of high-frequency current shown by the simulation results indicating current distribution on the surface of an antenna device according to the present embodiment in a simple fashion.

Next, FIG. 6 shows the result of analysis obtained by simulation of current distribution in an arbitrary phase on the surface of the antenna device (1) of the present embodiment, where the flow of high-frequency current is shown by the arrows in a simple fashion. As can be seen from FIG. 6, current distribution is concentrated within the antenna-occupied area (AOA) so that the flow of high-frequency current diffused to the ground plane (GND) is suppressed.

Specifically, high-frequency current can be readily flown in the direction shown by the arrow Y1 along the inside edges of the ground plane (GND) by series resonance of the antenna element (AT) and the second passive element (P2) so that the flow of high-frequency current diffused to the ground plane (GND) is suppressed.

Also, high-frequency current can be readily flown in the direction shown by the arrow 12 along the inside edges of the ground plane (GND) by a parallel resonance obtained by the stray capacitance (C1) and (C2) between the power feeding pattern (3) and the ground plane (GND) and the inductance (L) due to the ground connection pattern (5) so that the flow of high-frequency current diffused to the ground plane (GND) is suppressed. Furthermore, in the ground connection pattern (5) and the end side land portion (6), high-frequency current is flown in the same direction for contributing radiation (the direction shown by the arrow Y3) via the antenna element (AT) so that the flow of high-frequency current is mutually strengthened.

As described above, since the antenna device (1) of the present embodiment includes the antenna element (AT) of a dielectric antenna that is placed along the one side (2*a*) of the substrate main body (2) while one end (4*a*) of the electrodes is connected to the tip end of the power feeding pattern (3) extending within the antenna-occupied area (AOA), the second passive element (P2) that is connected between the other end (4*b*) of the electrodes of the antenna element (AT) and the ground plane (GND) adjoining thereto, and the ground connection pattern having an inductance that connects the tip end of the power feeding pattern (3) with the ground plane (GND) opposite to the antenna element (AT), current distribution is concentrated within the antenna-occupied area (AOA) so that the flow of high-frequency current diffused to the ground plane (GND) can be suppressed. In other words, the influence of peripheral components or the like upon installation on antenna performance can also be reduced.

Since the power feeding pattern (3) extends to one side (2*a*) of the substrate main body (2) and the ground connection pattern (5) is formed in contact with one side (2*a*) of the substrate main body (2), the antenna element (AT) and the ground connection pattern (5) are arranged at the edge of the substrate so that the antenna device can be utilized by deriving maximum performance from the antenna element (AT).

In order to secure a wide radiation space from the antenna element (AT), it is preferable that the antenna element (AT) is provided at the end of the substrate main body (2), i.e., at one side (2*a*) as close as possible.

Also, it is preferable that the ground connection pattern (5) is linearly connected from the power feeding pattern (3) with the shortest distance to the ground plane (GND).

Also, it is preferable that an opening enclosed by the inside edges of the power feeding pattern (3) (from the fine line portion (3*b*) to the power feeding-side land portion (3*a*)), the ground connection pattern (5), and the ground plane (GND) is as wide as possible.

Furthermore, it is preferable that the antenna-occupied area (AOA) is as large as possible.

Although the size of the substrate main body (2) has little effect on antenna performance, it is preferable that the size of the substrate main body (2) is about ¼ of a wavelength.

EXAMPLES

Next, a description will be given of the results of evaluation of the practically manufactured antenna device of the present embodiment in the present embodiment with reference to FIGS. 7 to 11.

Firstly, the substrate main body (2) having one side (2*a*) of 100 mm and a side perpendicular to the one side (2*a*) of 50 mm was made in the present embodiment. At this time, a 4.2 nH inductor was used as the first passive element (P1) and a 0.3 pF capacitor was used as the second passive element (P2). Furthermore, the power feeding point (FP) was provided at substantially the center of the substrate main body (2).

Figure 7:
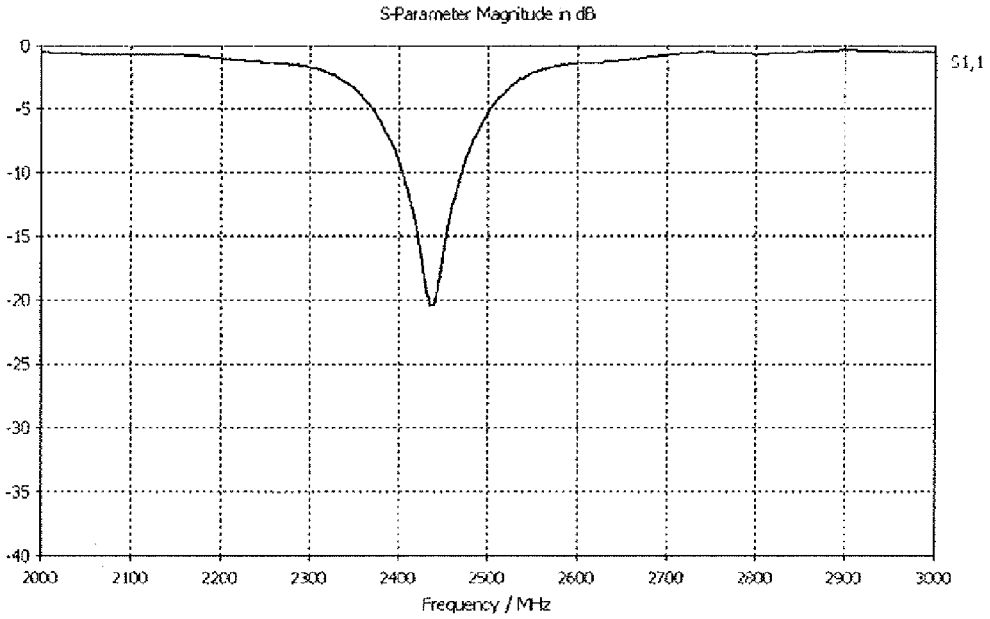
FIG. 7 is a graph illustrating return loss (reflection loss) characteristics of an antenna device according to an example of the present invention.
Figure 8:
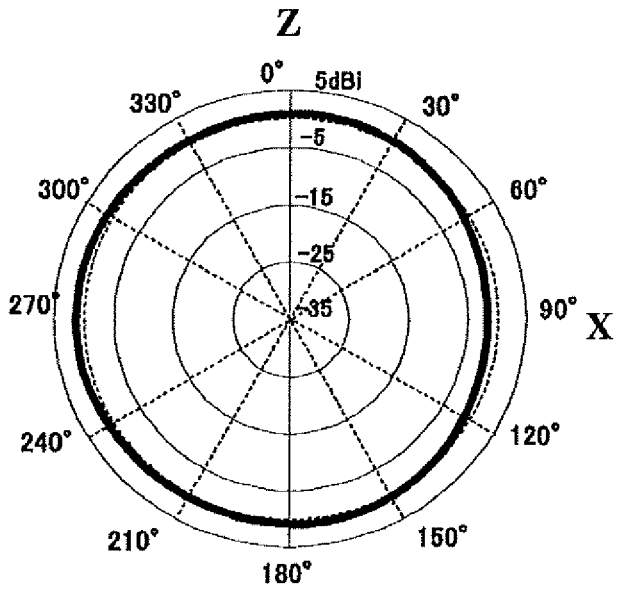
FIG. 8 is a graph illustrating the radiation pattern of an antenna device according to the present embodiment.
Figure 9:
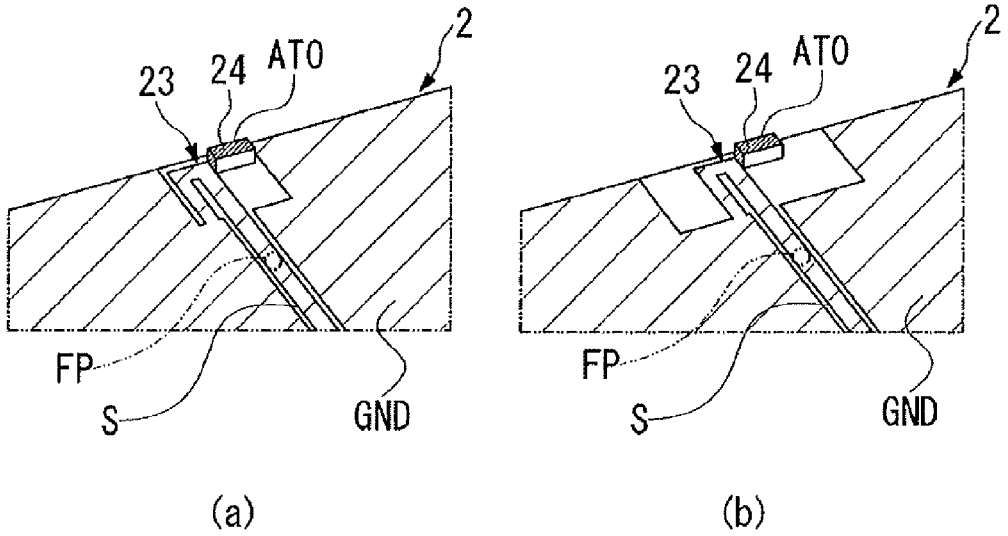
FIG. 9*a* is a perspective view illustrating the essential components of an antenna device according to conventional example 1 of the present invention.
FIG. 9*b* is a perspective view illustrating the essential components of an antenna device according to conventional example 2 of the present invention.

The results of return loss in the present embodiment are shown in FIG. 7. Also, the radiation pattern of an antenna device in the present embodiment is shown in FIG. 8. Note that the direction along which one side (2*a*) of the substrate main body (2) extends is defined as the Y direction, the direction along which the power feeding pattern (3) extends is defined as the X direction, and the vertical direction to the surface of the substrate main body (2) is defined as the Z direction. A vertical polarization wave to the Z-X plane in this case was measured.

In the present embodiment, this result indicates that a non-directional radiation pattern with small return loss is obtained so that high antenna performance can be realized.

Next, the antenna in the present embodiment having an antenna-occupied area (AOA) with the size of 5 mm×5 mm was made and inverse F-type antennas in conventional examples 1 and 2 as shown in FIGS. 9*a* and 9*b* was made as an open-end type conventional antenna. Then, the gains of the antennas in the present embodiment and conventional examples 1 and 2 were compared with each other.

In conventional example 1, the size of the antenna-occupied area (AOA) was set to 5 mm×5 mm as in the present embodiment as shown in FIG. 9*a*. In conventional example 2, the size of the antenna-occupied area (AOA) was set to 10 mm×5 mm as shown in FIG. 9*b* which was wider than that in the present embodiment. In each of conventional examples 1 and 2, an inverse F-shaped antenna element 23 to which an antenna element (AT0) is connected is provided. Note that the size of the substrate main body (2) was 100 mm×50 mm in conventional examples 1 and 2 as in the present embodiment. Also, the antenna element (AT0) is patterned with a copper foil 24 from the end surface of the antenna element (AT0), which is connected to the antenna element 23 of the dielectric base body, to the top surface thereof.

Figure 10:
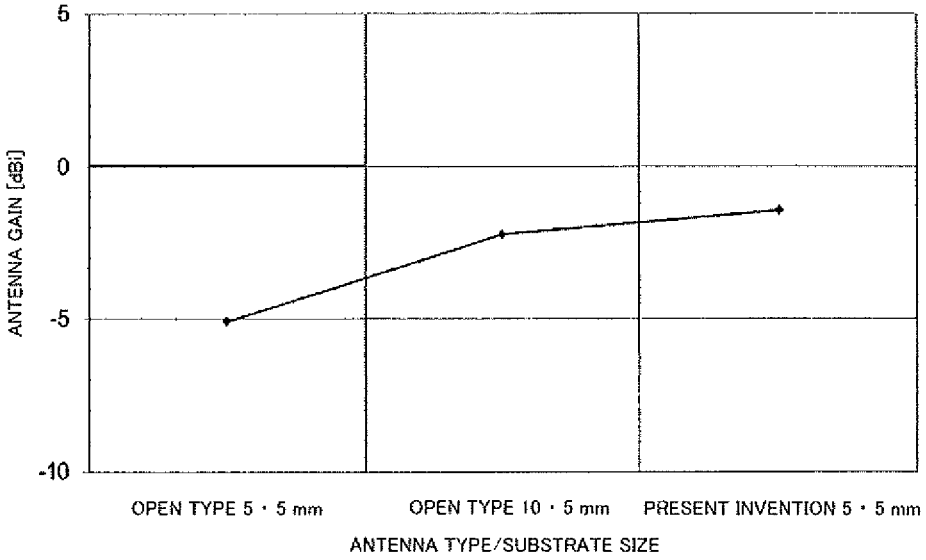
FIG. 10 is a graph comparing the gains of antennas in conventional example 1, conventional example 2, and example of the present invention.

FIG. 10 is a graph comparing the gains of antennas in the present embodiment, conventional example 1, and conventional example 2. In conventional example 1, the antenna was omnidirectional with a low gain of −5.07 dBi. Even in the antenna in conventional example 2 with the antenna-occupied area (AOA) being expanded for the purpose of improving the gain of the antenna, the omnidirectional antenna gain was improved only to −2.23 dBi. In contrast, the antenna in the present embodiment was omnidirectional with a high gain of −1.48 dBi despite the fact that the antenna-occupied area (AOA) was as small as that in conventional example 1. Consequently, the difference in antenna gain between the present embodiment and conventional example 1 and the difference in antenna gain between the present embodiment and conventional example 2 were 3.6 dB and 0.8 dB, respectively. As described above, in the present embodiment, high antenna performance can be realized even when the antenna-occupied area (AOA) is small.

Figure 11:
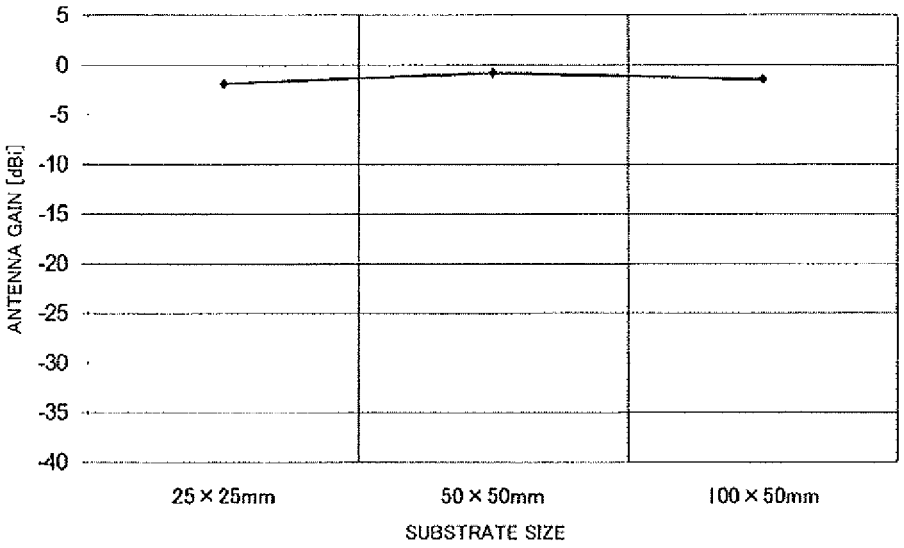
FIG. 11 is a graph illustrating the gain of an antenna according to the present embodiment when the size of a substrate is changed.

Next, three types of antennas with the size (one side (2*a*) of the substrate main body (2)×side perpendicular to the one side (2*a*)) of the substrate main body (2) of 100 mm×50 mm, 50 mm×50 mm, and 25 mm×25 mm were prepared as three examples, and then, the gain of the antennas were examined. FIG. 11 is a graph comparing the gains of the antennas in three examples with the modified size of the substrate main body (2).

As can be seen from this result, the antennas in examples with the size of the substrate main body (2) of 100 mm×50 mm, 50 mm×50 mm, and 25 mm×25 mm were omnidirectional with a gain of −1.48 dBi, −0.81 dBi, and −1.94 dBi, respectively. In these examples, antenna performance is hardly deteriorated even when the size of the substrate main body (2) is reduced.

The present invention is not limited to the aforementioned embodiment and Example and various modifications may be made without departing the spirit of the present invention.

For example, in the ground plane (GND) on the rear surface of the substrate main body (2), the portion opposing the surface of the slit section (S) may be the portion without the ground plane (GND) by linearly removing the ground plane (GND) as in the surface of the slit section (S).

Although, in the embodiment, the first passive element (P1) is provided at the portion disposed in the slit section (S) of the power feeding pattern (3), the first passive element (P1) may also be provided in the midway of the portion extending into the antenna-occupied area (AOA) of the power feeding pattern (3).

REFERENCE NUMERALS

1: antenna device, 2: substrate main body, 2*a*: one side of substrate main body, 3: power feeding pattern, 4*a*: one end (power feeding terminal) of electrodes of antenna element, 4*b*: the other end (ending terminal) of electrodes of antenna element, 5: ground connection pattern, AOA: antenna-occupied area, AT: antenna element, FP: power feeding point, GND: ground plane, P1: first passive element, P2: second passive element, S: slit section.

What is claimed is:

1. An antenna device comprising:

an insulating substrate main body;

a ground plane which is patterned with metal foil on the substrate main body;

an antenna-occupied area that is provided in contact with one side of the substrate main body on the substrate main body as an area in which the ground plane is not formed;

a slit section that is bored in the ground plane so as to extend from the antenna-occupied area in the direction opposite to the one side of the substrate main body;

a power feeding pattern that is patterned with metal foil so as to extend into the slit section, provided with a power feeding point at the base end side, and connected with a first passive element halfway while the tip end side extends into the antenna-occupied area toward the one side of the substrate main body;

an antenna element of a dielectric antenna that is constituted by a dielectric base body, a conductor pattern formed on the surface of the dielectric base body, and a pair of electrodes which are connected to each other by the conductor pattern and are formed at both ends of the dielectric base body and is placed along the one side of the substrate main body while one end of the electrodes is connected to the tip end of the power feeding pattern and;

a second passive element that is connected between the other end of the electrodes of the antenna element and the ground plane adjoining thereto; and a ground connection pattern having an inductance that is patterned with metal foil, connects the tip end of the power feeding pattern with the ground plane opposite to the antenna element, wherein the slit section separates the ground plane, and the ground plane is separated to a section connected to the second passive element and a section connected the ground connection pattern, which are respectively disposed on both sides of the power feeding pattern.

2. The antenna device according to claim 1, wherein the power feeding pattern extends to one side of the substrate main body, and the ground connection pattern is formed in contact with one side of the substrate main body.

* * * * *